US006105948A

United States Patent [19]

Young

[11] Patent Number: 6,105,948

[45] Date of Patent: Aug. 22, 2000

[54] MULTI-QUICK JAW ASSEMBLY

[76] Inventor: William L. Young, 792 Avocado Ave. #42, El Cajon, Calif. 92020

[21] Appl. No.: 09/357,788

[22] Filed: Jul. 12, 1999

[51] Int. Cl.[7] ..... B25B 1/20

[52] U.S. Cl. ..... 269/43; 269/244

[58] Field of Search ..... 269/43, 44, 252, 269/244

[56] References Cited

U.S. PATENT DOCUMENTS

| | | | |
|---|---|---|---|
| 2,662,433 | 12/1953 | Braun | 269/244 |
| 4,341,375 | 7/1982 | Romanin | 269/43 |
| 4,685,663 | 8/1987 | Jorgensen | 269/244 |
| 5,351,943 | 10/1994 | Milz | 269/43 |
| 5,702,096 | 12/1997 | Buck | 269/43 |

FOREIGN PATENT DOCUMENTS

| | | | |
|---|---|---|---|
| 154281 | 3/1982 | Germany | 269/44 |

*Primary Examiner*—David A. Scherbel
*Assistant Examiner*—Daniel G. Shanley
*Attorney, Agent, or Firm*—John J. Murphey

[57] ABSTRACT

An improved vise of the type comprising an elongated base defined by opposed, spaced-apart end edges and spaced-apart side edges, including a planar upper surface, and adapted to be mounted on the work surface of a machine that performs machining operations; an elongated first jaw fixedly mounted at one end of the base and having a jaw portion extending a short distance above the upper surface thereof; an elongated second jaw moveably mounted on the planar upper surface of the base, spaced-apart from the fixed jaw and parallel thereto, having a jaw portion extending a likewise short distance above the plane; opening/closing means passing underneath the planar upper surface and received in the second jaws in captive movement with the first jaw for drawing the jaws together and forcing them apart, and including a handle for turning the shaft means with respect to the jaws; the improvement comprising a plurality of elongated, floating jaw members, each member defined by a smooth base for sliding movement over the planar upper surface and a pair of parallel jaw side surfaces, held in spaced-apart arrangement by a top jaw surface, the jaw side surfaces arranged orthogonal to the planar upper surface, the members capable of clamping at least one part between and partially above the jaw surfaces of two, adjacent jaw members so that a plurality of similar parts for machining can be held in rigid, clamped arrangement between and partially above a plurality of the elongated jaw members and between the first and the second jaw members on the base for permitting accurate machining of all the parts in one machine operation.

11 Claims, 3 Drawing Sheets

MULTI-QUICK JAW ASSEMBLY

BACKGROUND OF THE INVENTION

1. Field of the Invention

This invention pertains to the field of metal working machinery. More particularly, it pertains to equipment for holding a workpiece in a particular position while another machine performs operations on the workpiece such as boring, shaving, grinding, drilling and the like. This particular invention is used to hold a plurality of similar parts in rigid and accurate position while the machine performs the same operation on each part.

2. Description of the Prior Art

Industry requires many mechanical operations be performed on a single part before its assembly can be completed. Numerous parts are often required to build products and each part must be molded, cut, drilled, and ground to finished tolerances before it can be made a part of the finished product. The machines that perform these operations are usually large and stationary. The parts must be brought to the machine and placed on a work surface before the machine can begin its operation.

While one or two parts may be easily and efficiently mounted in a vise or other part holder, where a large number of similar parts are to be machined, mounting one or two at a time becomes wasteful of time and manpower, and also prevents the machine from performing the operation in an efficient manner. Various designs of vises have been tried in order to mount a plurality of similar parts on the work surface of the machine so that the machine can perform the same operation on the parts in a rather large batch thus reducing the time to mount each part.

In almost every case, vises of the prior art have been made using a single pair of clamping jaws to hold one part at a time. To hold a plurality of parts, the mounting base is just made bigger and heavier and the pair of clamping jaws are duplicated so that while there are more pairs of clamping jaws on the mounting base, each pair continues to hold only one part. While this type of vise allows for mounting more than one part at a time, each part must be separately adjusted in its own vise which results in longer time periods to set up the mounting plate as well as continuing the inefficiency of the past.

SUMMARY OF THE INVENTION

This invention is an improvement in a vise for holding a plurality of separate parts that require the same machining operation on each part. The improvement makes the vise capable of loading a plurality of parts in rapid succession and in the proper alignment so that the parts may be machined rapidly and accurately thus increasing the efficiency of the overall machining process. The invention is an improvement in a vise for holding multiple parts in an arrangement that allows them to be machined all in one operation, comprising an elongated base defined by opposed, spaced-apart end edges and spaced-apart longer side edges, including a planar upper surface, and adapted to be mounted on the work surface of a machine that performs machining operations, an elongated first jaw fixedly mounted at one said end of said base and having a jaw portion extending a short distance above the upper surface thereof to a height that is less than the height of the parts after they are mounted on the planar upper surface, an elongated second jaw moveably mounted on the planar upper surface of the base, spaced-apart from the fixed jaw and parallel thereto, having a jaw portion extending a likewise short distance above the plane to a height that is less than the height of the parts after they are mounted on the planar upper surface, a screw shaft of terminal length passing underneath the planar upper surface, pivotally anchored in the first fixed jaw and journaled in the second fixed jaw for drawing the jaws together and forcing them apart in response to the turning of a handle attached to one end thereof, a plurality of elongated, floating jaw members, each member defined by a smooth base for sliding movement over the planar upper surface and a pair of outwardly-facing parallel jaw member side surfaces, held in spaced-apart arrangement by a jaw member top surface, the jaw member side surfaces arranged orthogonal to the planar upper surface, the jaw members capable of clamping at least one part between and partially above the jaw member top surfaces of two, adjacent jaw members so that a plurality of similar parts for machining can be held in rigid, clamped arrangement between and partially above a plurality of the elongated jaw members and between said first and second jaw members on the base for permitting accurate machining of all the parts in one machine operation.

Accordingly, the main object of this invention is a multiple-part mounting vise that quickly loads a plurality of parts for machining in a single operation. Other objects include a vise providing better repeatability of machining from part-to-part; a vise that helps eliminate parts being located improperly on the machine; a vise that is versatile for quick part set-up; a vise that reduces repetitious single part loading and unloading; a vise that results in reduced tool change time and allows the machine to operate on more parts per tool change; and, a vise that reduces clean-up time by loading a larger plurality of parts for one operation than that of the prior art.

These and other objects of the invention will become more clear when one reads the following specification, taken together with the drawings that are attached hereto. The scope of protection sought by the inventors may be gleaned from a fair reading of the Claims that conclude this specification.

DESCRIPTION OF THE PREFERRED EMBODIMENT

Figure 1:
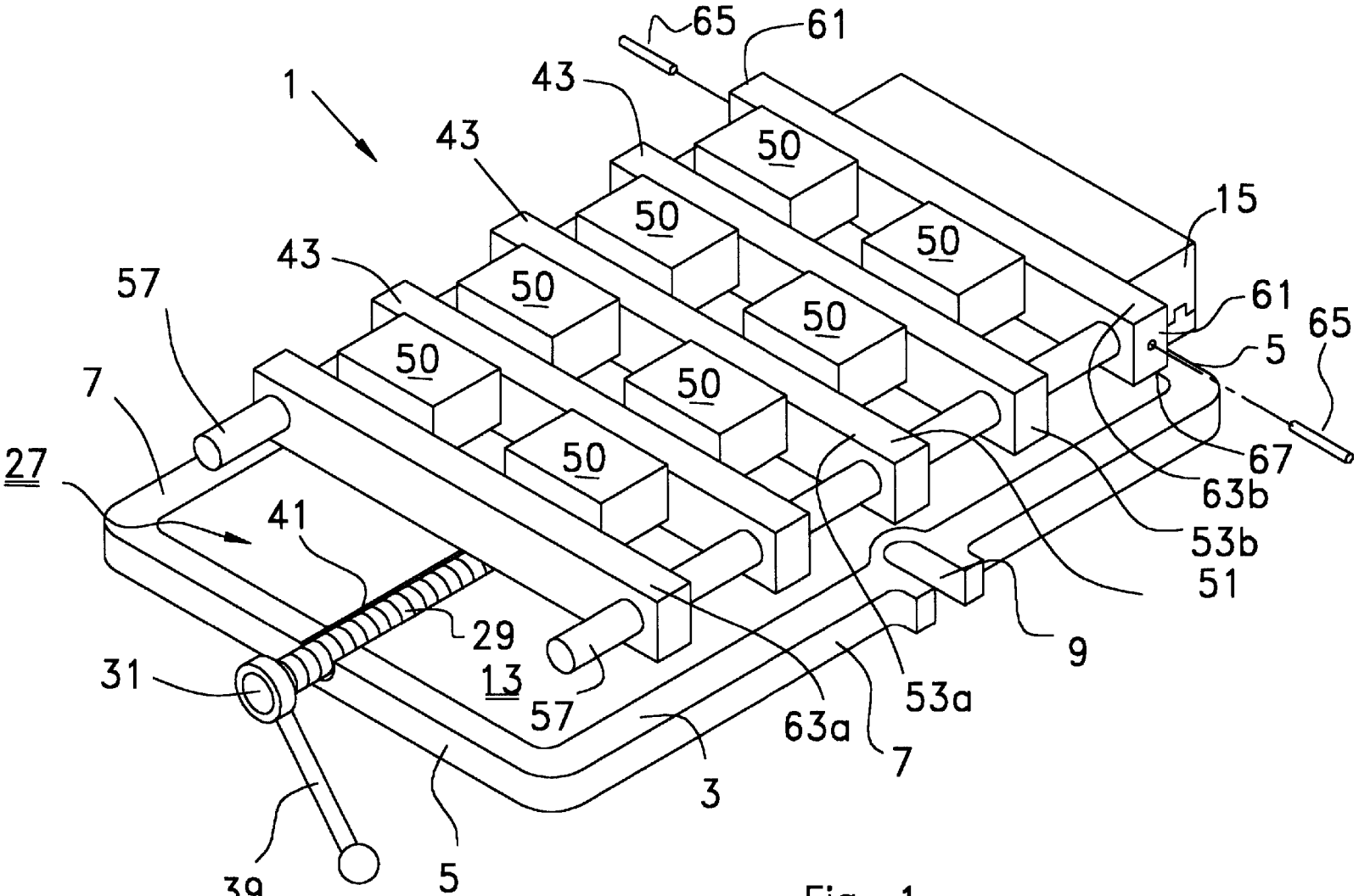
FIG. 1 is a perspective view of the preferred embodiment of the invention.

Turning now to the drawings wherein elements are identified by numbers and like elements are identified by like numbers throughout the five figures, the improved vise 1, for holding multiple parts in an arrangement that allows them to be machined all in one operation, is depicted in FIG. 1, and is shown to comprise an elongated base 3 made of tool steel and defined by opposed, spaced-apart end edges 5 and spaced-apart longer side edges 7, end edges 5 and side edges 7 meeting at their respective corner intersections and preferably having an overall rectangular shape. Base 3 is preferably of a thickness "T" that allows the formation of a number of cutouts 9 formed therein, along edges 5 and 7, for receipt therethrough of mounting bolts (not shown) to rigidly mount vise 1 to the work surface of a machine, such as a grinding machine, as is well known in the art. Base 3 includes a planar upper surface 13 on which the parts to be machined are to be mounted as will hereinafter be more fully explained.

Figure 2:
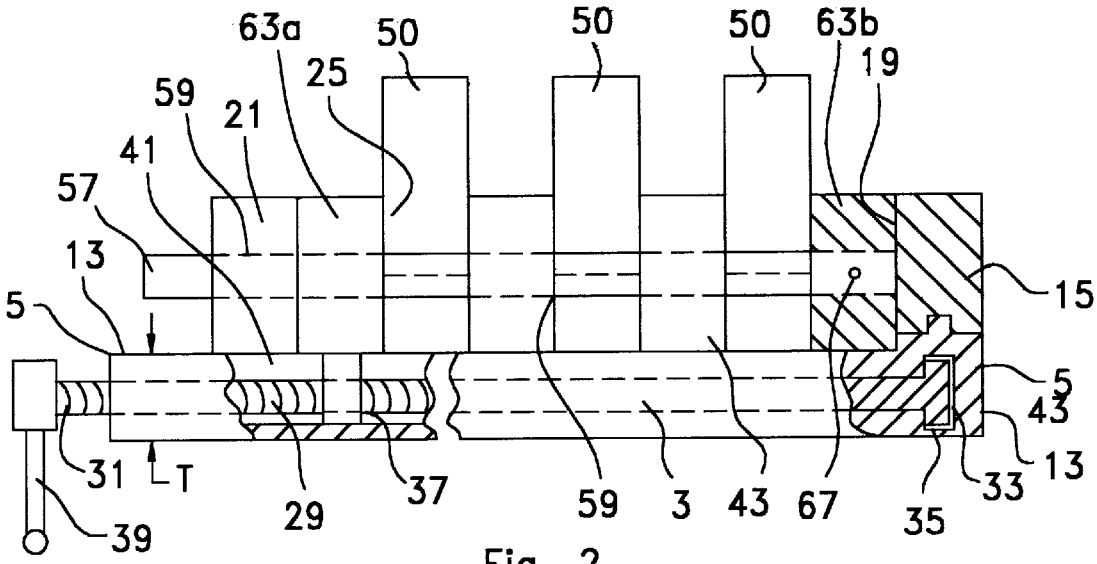
FIG. 2 is a side view, partially in section, of an embodiment similar to that shown in FIG. 1.

An elongated first jaw 15 is fixedly mounted to one end edge 5 of base 3, substantially across the width of base 3, and has a jaw portion 17 that extends a short distance above base upper surface 13, preferably to a height that is less than the height of the parts to be placed thereon, after they are mounted in vise 1. The fixed mounting of first jaw 15 is preferably done using slots and keys (not shown) cut in both first jaw 15 and in base 3, as well as the use of set screws, as is recognized in the machining industry. While first jaw 15 is termed "fixed", it should be recognized that it is also removable from base 3 by unscrewing the hold-down screws and bolts used to hold jaw 15 to end edge 5. As shown in FIG. 2, first jaw 15 may have formed thereon a holding surface 19 for use in abutment against one or more parts to be machined.

An elongated second jaw 21 is shown in FIGS. 1 and 2, preferably of similar size and shape to first jaw 15, and is moveably mounted on base upper surface 13 preferably in spaced-apart arrangement from first, fixed jaw 15 and parallel thereto. Second jaw 21 has a holding surface 25 extending a likewise short distance above upper surface 13 to a height generally equal to the height of first jaw portion 17 above surface 13 and is also less than the height of the parts after they are mounted in vise 1 and on planar upper surface 13.

Opening/closing means 27 is provided to force apart first fixed jaw 15 and second jaw 21 or, alternatively, draw them together on base upper planar surface 13. As shown in FIGS. 1 and 2, means 27 is shown to be an externally threaded shaft 29, defined by spaced-apart first and second distal ends 31 and 33, respectively, said shaft 29 preferably located under planar surface 13, wherein first distal end 31 is pivotally anchored at 35 in first fixed jaw 15 and journaled in a threaded bore 37 formed in second fixed jaw 21. A handle 39 is provided and attached to shaft distal end 31 for turning to advance or withdraw second jaw 21 vis-a-vis first, fixed jaw 15. Preferably, threaded shaft 29 is located in a slot 41 formed in base 3 opening from upper surface 13 and extending downward.

The improvement, and the center point of this invention, is now described. As shown in FIGS. 1 through 5, a plurality of elongated, floating jaw members 43 are provided. Each member 43 is defined by a smooth base 45 for sliding movement (floating) over planar upper surface 13 and a pair of outwardly-facing parallel jaw member side surfaces 49*a* and 49*b*, held in spaced-apart arrangement by a jaw member top surface 51. Jaw member side surfaces 49*a* and 49*b* are arranged orthogonal to planar upper surface 13 and are capable of clamping at least one, but more preferably a plurality of parts 50, between and partially above jaw member top surfaces 51 of two, adjacently arranged jaw members so that a plurality of similar parts for machining can be held in rigid, clamped arrangement between and partially above a plurality of said elongated jaw members and between first and second jaw members 15 and 21 on base 3 for permitting accurate machining of all the parts in one machine operation as is shown in FIG. 1. It is preferred that the cross-section of floating jaw members 43 be rectangular and that top surface 51 be separated from side surfaces 49*a* and 49*b* by at least one, but preferably two, right-angled corners 53*a* and 53*b*, respectively. This cross-sectional design allows at least one deep, narrow slot 55 to be formed, beginning on top surface 51 and inward from one corner 53*a* or 53*b* and progressing down into jaw member 43 to provide a means for absorbing any dimensional change occurring to the jaw side surfaces due to tightening the parts between jaw members 43 in vise 1.

Figure 3:
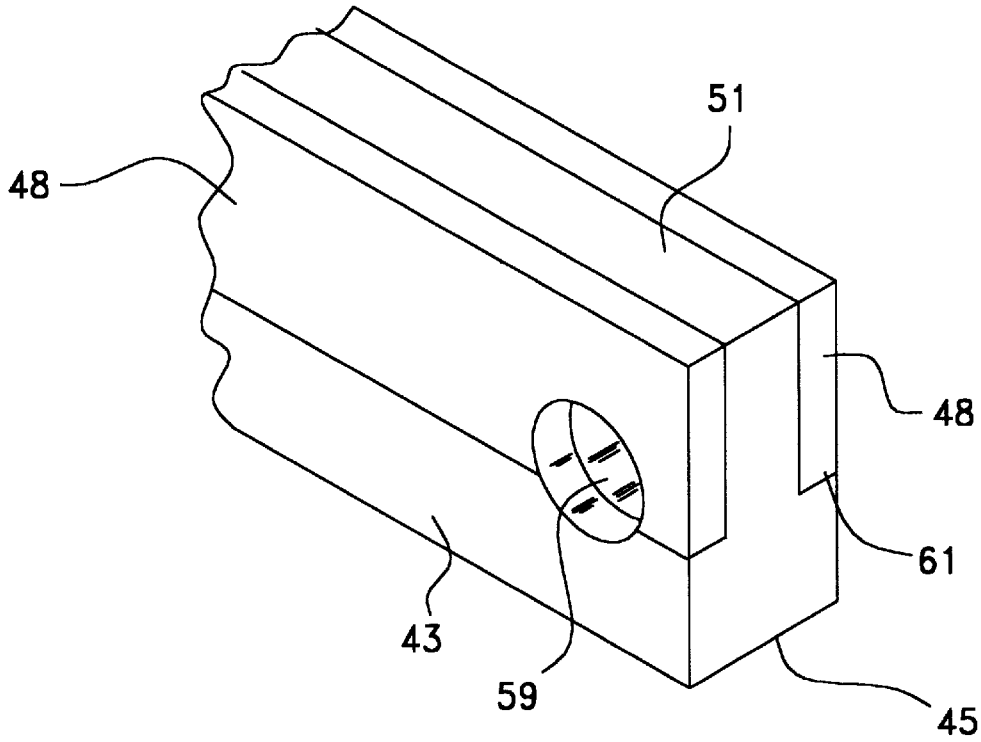
FIG. 3 is a perspective view of one end of a floating jaw member of this invention showing the use of a strip of soft metal on the flat side surfaces of said member.

It is also preferred that first jaw 15 and second jaw 21 be made of a hard steel to prevent any distortion to vise 1 during use. As is shown in FIG. 3, in one embodiment of the invention, elongated jaw members 43 have flat side surfaces 47*a* and 47*b* and at least a portion of them is made of a softer metal than the metal from which said first and said second jaws are made, such as a strip 48. This softer metal could be a softer grade of steel or a totally softer metal of a different family of metals, such as Aluminum. While the invention will operate correctly with floating jaw members of different height, much more efficiency is achieved when jaw members 43 are all the same size and, especially, the same height.

Figure 4:
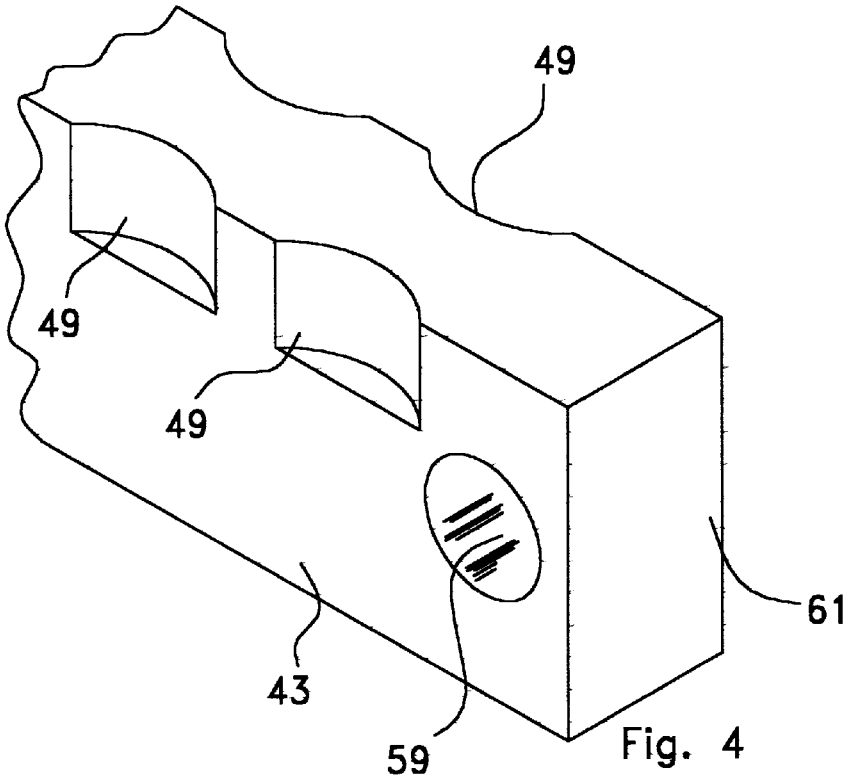
FIG. 4 is a perspective view of one end of another floating jaw member of this invention showing the use of a deep slot along the upper portion thereof to take up any distortion when clamping a part therein; and, FIG. 5 is a perspective view of one end of a floating jaw member of this invention showing the use of contoured side surfaces in the flat side surfaces of said member to accommodate parts of different profiles.
Figure 5:
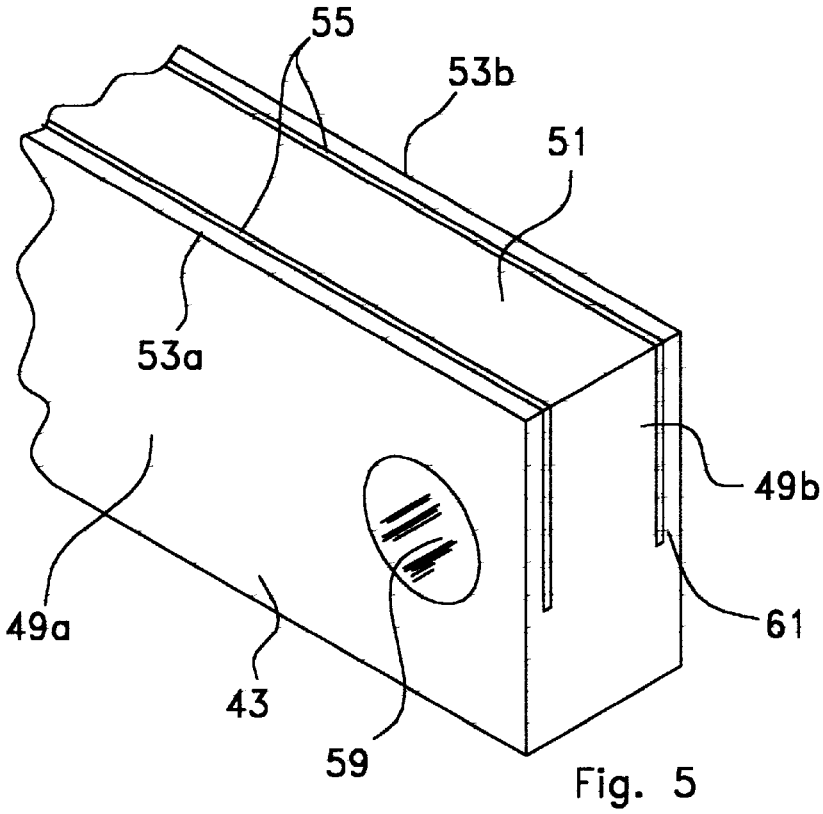

While in FIG. 4, side surfaces 47*a* and 47*b* are shown to be flat, they may have various contours 49 cut in them to more easily accept the profiles of certain parts in order to stack them and retain them in the vise.

As shown in FIGS. 1 and 2, vise 1 may also include a pair of spaced-apart guide rods 57, each guide rod 57 received in sliding relationship in a bore 59 formed in at least one elongated jaw member 43 near the distal ends 61 of said member. Guide rods 57 are arranged parallel to threaded shaft 29 for guiding the movement of a plurality of elongated jaw members 43 over planar upper surface 13 along exact paths wherein jaw members 43 are held parallel to each other and parallel to first and second jaws 15 and 21 for positioning on each side of a part held therebetween to accurately present each part to the machine operation.

A pair of end jaw members 63*a* and 63*b*, preferably of the same dimensions as floating jaw members 43 and made from the same softer metal as jaw members 43, is provided for placement adjacent first and second jaw members 15 and 21 to present the same softness of metal against the parts held between end jaw members 15 and 21 and floating jaw members 43. End jaw members 63*a* and 63*b* may be bolted directly to fixed first jaw 15 and moveable second jaw 21.

As shown in FIGS. 1 and 2, at least one locking pin 65 is provided for each guide rod 57 and arranged to be inserted through a matching bore 67 formed in the end of jaw member 63*b* and into guide rod 57. The purpose of locking pins 65 is to hold guide rods 57 in fixed position when vise 1 is closed upon a plurality of parts.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. In a vise, comprising:

a) an elongated base defined by opposed, spaced-apart end edges and spaced-apart side edges, including a planar upper surface, and adapted for mounting on the work surface of a machine that performs machining operations;

b) an elongated first jaw fixedly mounted at one said end of said base and having a jaw portion extending a distance above said upper surface thereof;

c) an elongated second jaw moveably mounted on said planar upper surface of said base, spaced-apart from said fixed jaw and parallel thereto, having a jaw portion extending a distance above said plane;

d) opening/closing means passing underneath said planar upper surface and received in said second jaws in captive movement with said first jaw for drawing said jaws together and forcing them apart, and including a handle for turning said shaft means with respect to said jaws; the improvement that allows a plurality of like parts to be retained in the vise so that they can be machined all in one operation, said improvement comprising:

e) a plurality of elongated, floating jaw members, each said member defined by a smooth base for sliding movement over said planar upper surface and a pair of parallel jaw side surfaces, held in spaced-apart arrangement by a top jaw surface, said jaw side surfaces arranged orthogonal to said planar upper surface, said members capable of clamping at least one part between said jaw surfaces of two, adjacent jaw members so that a plurality of similar parts for machining can be held in rigid, clamped arrangement between said elongated jaw members for permitting accurate machining of all the parts in one machine operation; and, f) wherein said floating, elongated jaw members are defined by a cross-sectional shape that includes at least one corner formed between said upper jaw surface and one of said jaw side surfaces and wherein said jaw member has formed therein at least one deep slot near said corner for deforming and absorbing any dimensional change occurring to said jaw side surfaces due to tightening the parts between said jaw members in the vise.

2. The improved vise of claim 1 wherein said elongated jaw members have flat jaw surfaces, are made of a softer metal than the metal from which said first and said second jaws are made, and wherein each elongated jaw member is of the same height as every other said elongated jaw member.

3. The improved vise of claim 2 wherein said elongated jaw members are machined in various profiles to accept a greater surface area of the parts than if said members had a flat jaw surface.

4. The improved vise of claim 1 further including a pair of spaced-apart guide rods, each said guide rod received in sliding relationship with at least one elongated jaw member near the distal ends of said member, said rods arranged parallel to said threadable shaft means for guiding the movement of a plurality of said elongated jaw members over said planar upper surface along exact paths wherein said jaw members are held parallel to each other and parallel to said first and second jaws for positioning on each side of a part held therebetween to accurately present each part to the machine operation.

5. The improved vise of claim 2 further including end jaw members, of the same dimensions as said floating jaw member, and made from the same softer metal than said first and second jaw members, for placement adjacent said first and second jaw members to present the same softness of steel against the parts held between said end jaw members and said floating jaw members and further including at least one locking pin for each guide rod used in said vise, each said pin arranged to be inserted through matching bores formed through a portion of said floating jaw members and into said guide rods, to hold said guide rods in fixed position when said vise is closed upon a plurality of parts.

6. The improved vise of claim 5 wherein said elongated, floating jaw members are further defined by a length that substantially spans the width of said planar upper surface of said base and are terminated by spaced-apart jaw member distal ends, wherein said pair of spaced-apart guide rods are arranged to be received in bores formed in said floating jaw members near said distal ends.

7. The improved vise of claim 1 wherein said cross-sectional shape of said floating jaw members is rectangular.

8. The improved vise of claim 1 wherein at least one indentation is formed in said jaw side surfaces of said elongated, floating jaw members to accept portions of parts for gripping in said vise.

9. In a vise, comprising:

a) an elongated base defined by opposed, spaced-apart end edges and spaced-apart longer side edges, including a planar upper surface, and adapted to be mounted on the work surface of a machine that performs machining operations;

b) an elongated first jaw fixedly mounted at one said end of said base and having a jaw portion extending a distance above said upper surface thereof;

c) an elongated second jaw moveably mounted on said planar upper surface of said base, spaced-apart from said fixed jaw and parallel thereto, having a jaw portion extending above said plane on said;

d) a threadable shaft of terminal length passing underneath said planar upper surface, pivotally anchored in said first fixed jaw and journaled in said second fixed jaw for drawing said jaws together and forcing them apart in response to the turning of a handle attached to one end thereof; the improvement allowing a plurality of parts to be held in said vise to allow all parts to be machined in one operation, the improvement comprising:

e) a plurality of elongated, floating jaw members, each said member defined by a smooth base for sliding movement over said planar upper surface and a pair of outwardly-facing parallel jaw member side surfaces, held in spaced-apart arrangement by a jaw member top surface, said jaw member side surfaces arranged orthogonal to said planar upper surface, said jaw members capable of clamping at least one part between two adjacent jaw members so that a plurality of similar parts for machining can be held in rigid, clamped arrangement between said elongated jaw members on said base for permitting accurate machining of all the parts in one machine operation; and, f) wherein said elongated jaw members have flat jaw surfaces and contain an area of a softer metal than the metal from which said jaws are made, to deform slightly about the parts held therebetween and increase the holding power of said jaw members on the parts held therebetween.

10. The improved vise of claim 9 wherein said floating jaw members are further defined by a pair of spaced-apart distal ends and said vise further includes a pair of spaced-apart guide rods, each said guide rod received in sliding relationship with at least one elongated floating jaw member near said distal ends of said member, said rods arranged parallel to said threadable shaft means for guiding the movement of a plurality of said elongated jaw members over said planar upper surface along exact paths wherein said jaw members are held parallel to each other and parallel to said first and second jaws for positioning on each side of a part held therebetween to accurately present each part to the machine operation.

11. The vise of claim 9 further including at least one locking pin for each guide rod used in said vise, each said pin arranged to be inserted through matching bores formed through a portion of said floating jaw members and into said guide rods, to hold said guide rods in fixed position when said vise is closed upon a plurality of parts.

* * * * *